US007312706B1

(12) United States Patent
Montgomery

(10) Patent No.: US 7,312,706 B1
(45) Date of Patent: Dec. 25, 2007

(54) MICROPROCESSOR OPERATED EARLY WARNING ASHTRAY

(76) Inventor: Tony Chavers Montgomery, 3926 NE. 12th Ave., Portland, OR (US) 97212

( * ) Notice: Subject to any disclaimer, the term of this patent is extended or adjusted under 35 U.S.C. 154(b) by 470 days.

(21) Appl. No.: 11/131,094

(22) Filed: May 16, 2005

(51) Int. Cl.
*G08B 13/14* (2006.01)

(52) U.S. Cl. ..... 340/570; 340/584; 340/588; 340/689; 131/231; 131/240.1; 131/242.5; 220/576

(58) Field of Classification Search ..... 340/570, 340/581, 584, 588, 686.1, 689; 131/231, 131/240.1, 241, 242.5, 187, 330; 220/576, 220/592.01, 592.11, 911
See application file for complete search history.

(56) References Cited

U.S. PATENT DOCUMENTS 4,595,905 A * 6/1986 May ..... 340/309.7
4,725,998 A * 2/1988 Jones ..... 368/10
4,996,995 A * 3/1991 Kojima ..... 131/238
5,132,668 A * 7/1992 Lee ..... 340/584

* cited by examiner

*Primary Examiner*—Davetta W. Goins
(74) *Attorney, Agent, or Firm*—Mark S. Hubert

(57) ABSTRACT

The present invention is a battery powered, portable microprocessor based early warning alarming ashtray. It provides the smoker two different time limited unattended cigarette alarms, as well an alarm for a tipped ashtray; an alarm for a bumped ashtray; an alarm based on nearby or lower elevation smoke by either of the two smoke detection devices; and a low power alarm. It offers "full protection" for most of the likely scenarios encountered by smokers that could result in a fire. Emptying of the ashtray by tipping overrides and disables the tipping alarm momentarily. Since the apparatus is microprocessor controlled, the timing intervals and magnitude of the different alarm notifications can be preprogramed as well as the sensitivity of the smoke detector devices.

20 Claims, 6 Drawing Sheets

MICROPROCESSOR OPERATED EARLY WARNING ASHTRAY

BACKGROUND OF THE INVENTION

The present invention relates to a smoker's ashtray capable of both preventing and detecting cigarette related fires and more particularly, to a microprocessor based battery powered early fire detection and prevention apparatus.

Cigarette related fires are commonplace. They rank as the number one cause of residential fires and residential fire related deaths. It is well documented that many of the cigarette related fires stem from a lit cigarette that is knocked from an ashtray, a lit cigarette that burns unattended and shortens until it tips from the ashtray, or a person who falls asleep while smoking. Although early warning smoke detectors are commonplace in most residences, their proximity to the source of the smoke is directly related to the amount of time available to rectify the situation before it gets out of hand. Furthermore, many smokers prefer to disable their ceiling mounted smoke detectors if they smoke indoors as the hot rising smoke particles continually set off the alarms.

Prior art alarming ashtrays attempting to offer early warning focus on the status of the cigarette and its positioning by pressure micro switches, heat sensors and the like. Their detection/sensing capabilities end when the cigarette is extinguished, or when the cigarette leaves the ashtray. This does not account for tipped ashtrays, cigarettes that have fallen out of the ashtray and cigarettes that never return to the ashtray after use. Furthermore, these require certain ongoing interactions between the smoker and the ashtray, such as the resetting of their alarming mechanisms.

The present invention offers true "full protection" for most of the likely scenarios caused by smokers that can potentially result in a fire. The ashtray notifies the smoker when their cigarette has been lefty unattended in the ashtray for a predetermined period of time. Continuing to fail to attend to the cigarette after a lengthier period of time prompts a stronger notification. Bumping or tilting the ashtray beyond a preset angle initiates a continual notification until the situation is remedied. Emptying of the ashtray by tipping overrides and disables the tipping alarm momentarily. If a lit cigarette falls in the vicinity of the ashtray, the cigarette smoke and/or smoke from ignited combustible materials will instigate another alarm. The apparatus also warns the user of a low battery condition. Since the apparatus is microprocessor controlled, the timing intervals and magnitude of the different alarm notifications can be preprogramed as well as the sensitivity of the smoke detectors.

Henceforth, a "full protection" alarming ashtray would fulfill a long felt need in the industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a new and improved early warning smoker's ashtray that will alert the user of potential fire causing scenarios as well as to actual smoke generating situations.

It has many of the advantages mentioned heretofore and many novel features that result in a new early warning ashtray which is not anticipated, rendered obvious, suggested, or even implied by any of the prior art, either alone or in any combination thereof.

In accordance with the invention, an object of the present invention is to provide an improved ashtray that automatically notifies a smoker when they have exceeded a preset time limit for leaving a cigarette unattended in the ashtray.

It is another object of this invention to provide an improved ashtray that automatically gives a second, stronger notification when the unattended cigarette is not attended to for a second lengthier time interval.

It is a further object of this invention to provide an improved ashtray that automatically gives the user a notification if the ashtray has been tipped over or bumped.

It is still a further object of this invention to provide for an improved ashtray that automatically alarms the user if there is a smoke emitting source near or below the ashtray.

It is yet a further object of this invention to provide an improved ashtray that automatically provides the user with a notification of the battery status.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
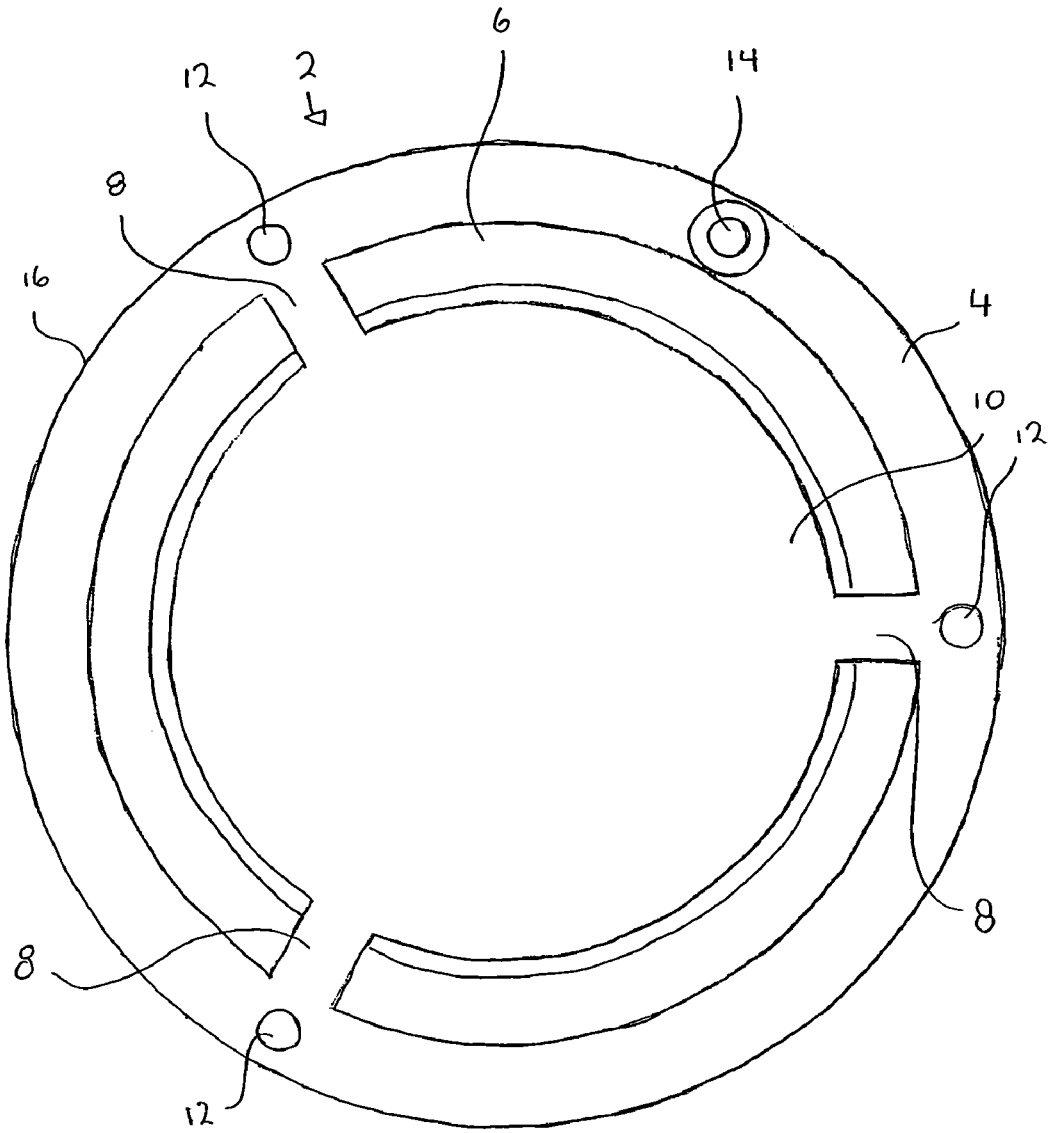
FIG. 1 is a top view of the ashtray showing the general arrangement of some of the components.
Figure 3:
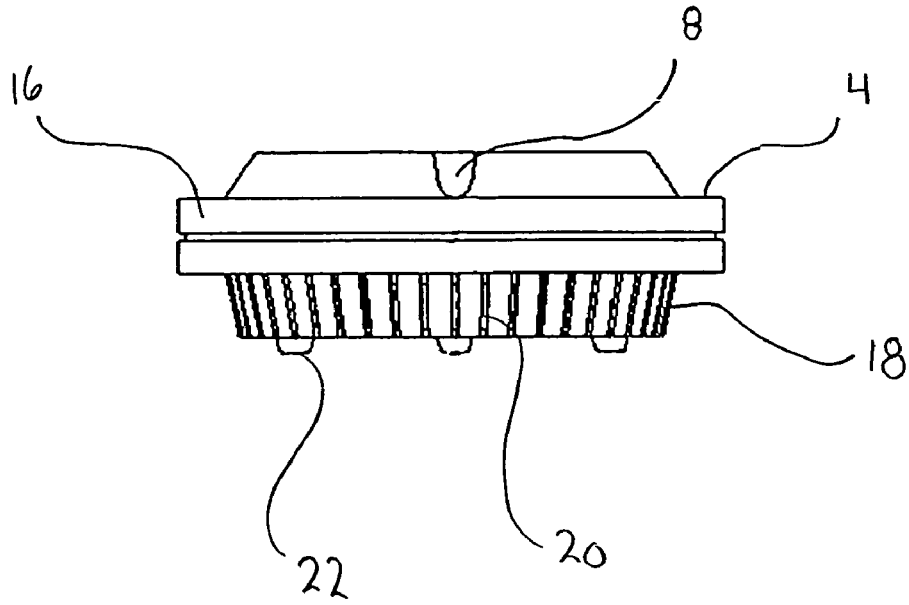
FIG. 3 is a side view of the ashtray showing it's general configuration.
Figure 2:
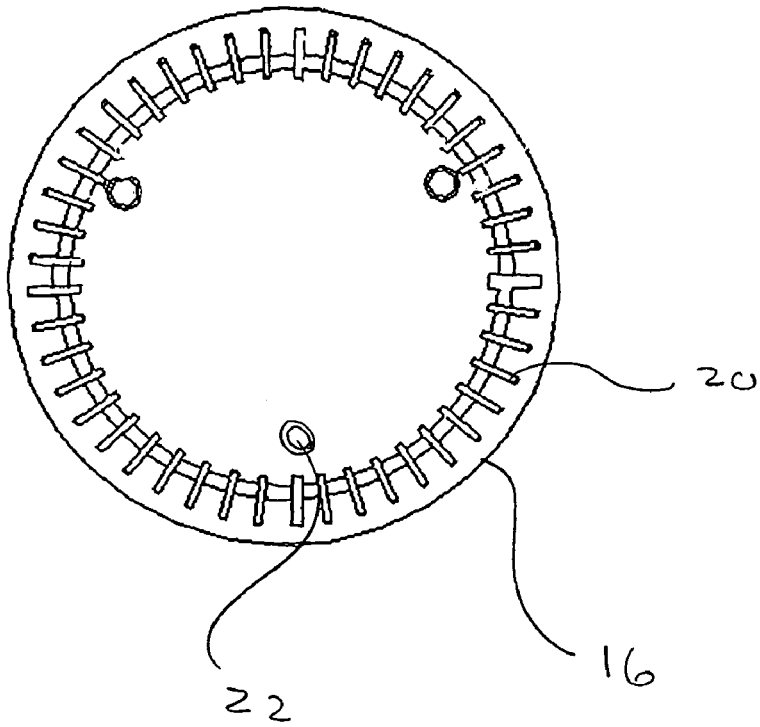
FIG. 2 is a bottom view of the ashtray showing it's general configuration.

Looking at FIGS. 1, 2 and 3 it can be seen that the ashtray body 2 is comprised of two matingly engagable polymer parts. There is an upper ashpan housing 16 and a vented lower component housing 18. The upper ashpan housing 16 has flange 4 and an ashpan 10 separated by a raised ring 6 with generally hemispherical cigarette grooves 8 formed there through. The location of cigarette optical sensors 12 and override optical sensor 14 in relation to grooves 8 and ashpan flange 4 are indicated and are visible through the ashpan housing 16 from a top view. Lower component housing 18 has multiple vents 20 disposed about the circumference to allow the movement of local air and smoke into the vicinity of the smoke detector sensors. The preferred embodiment ashtray 1 has feet 22 formed on the base of the lower component housing 18. These may be made of the same material as the rest of the astray body 2 or of a gripable polymer or rubber.

The material of construction for the preferred embodiment is an infra red translucent, heat resistant polycarbonate, although other infra red translucent compounds will suffice, or other heat resistant substrates having regions of infra red translucent material adjacent to the sensors. The entire body 2 need not be made from the same infra red translucent material, as the infra red translucent property is only critical in the areas directly above and adjacent to where the cigarette optical sensor 12 and override optical sensor 14 are located.

Figure 5:
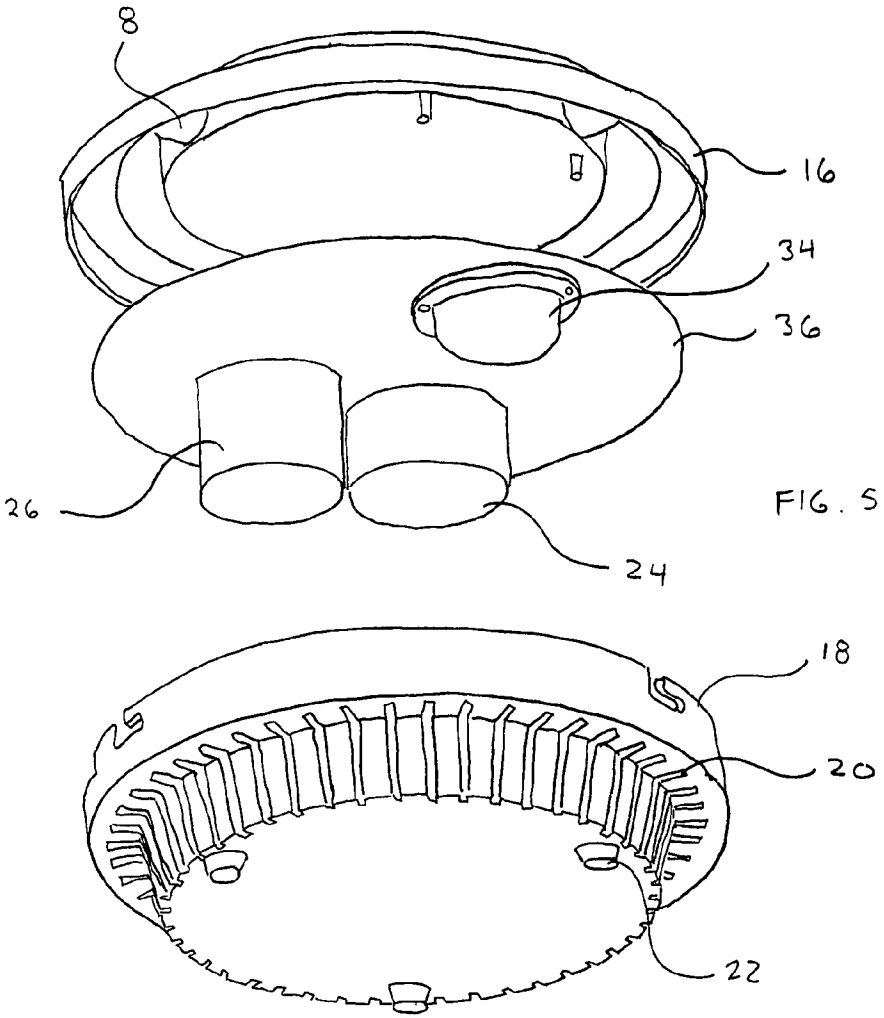
FIG. 5 is an exploded view showing the location of the major components of the ashtray.

FIG. 5 illustrates an exploded view of the physical location of the major components of the ashtray. It also illustrated the engagement slots on the vented lower component housing 18 that allows it to matingly connect to upper ashpan housing 16.

Figure 4:
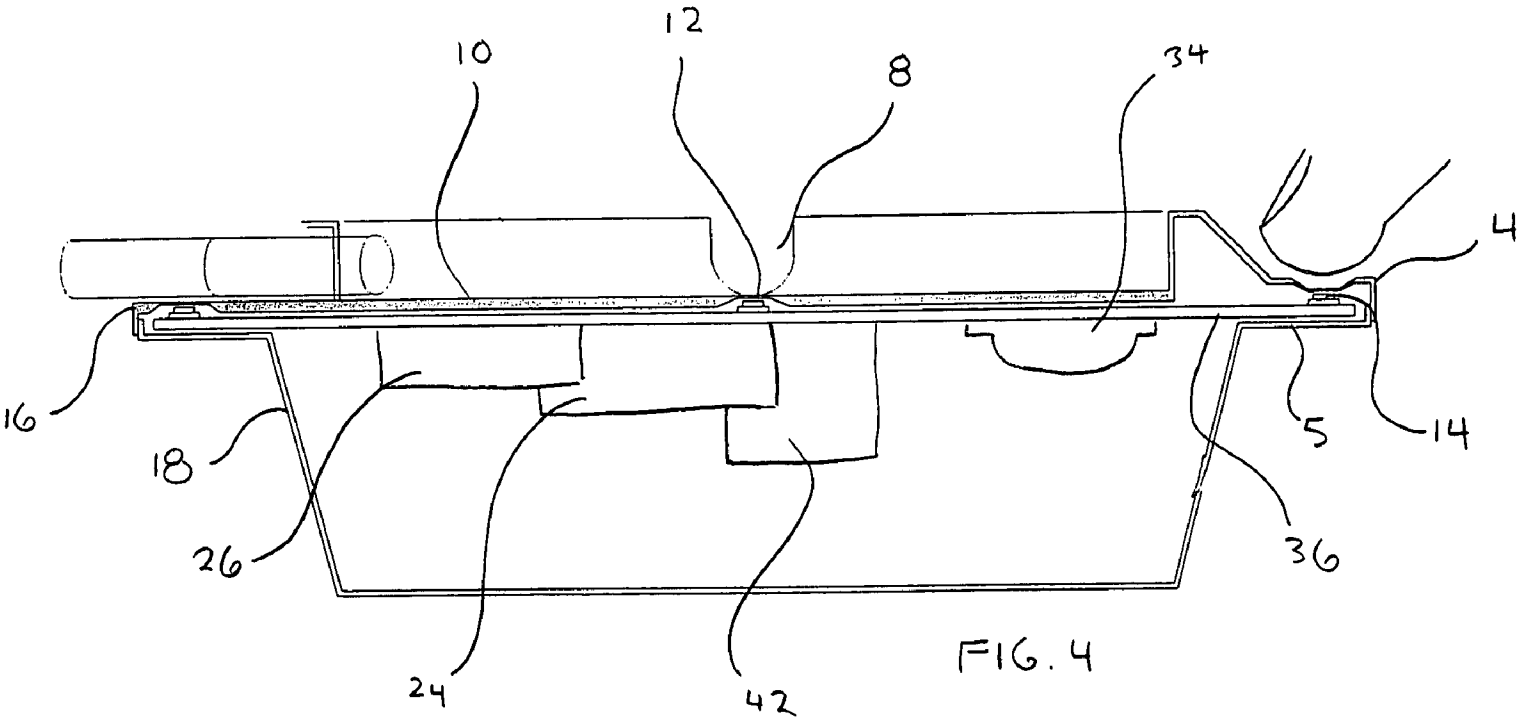
FIG. 4 is a side cross sectional view of the ashtray showing the general arrangement of the ashtray's major components.

Referring now to FIG. 4, the circuit board 36 is a circular, double sided, standard phenolic circuit board capable of withstanding temperatures in excess of those generated by a cigarette alone before distorting or experiencing melting of the conductive circuit pathways 44. The circuit board 36 rests on flange 5 of the lower component housing 18 and is held in place by the close tolerance between the upper ashpan flange 4 and the vented lower component housing flange 5 and adhesive. The preferred embodiment uses a 25 mm separation between the bottom of the ashpan 10 and the top face of the circuit board 40.

Figure 6:
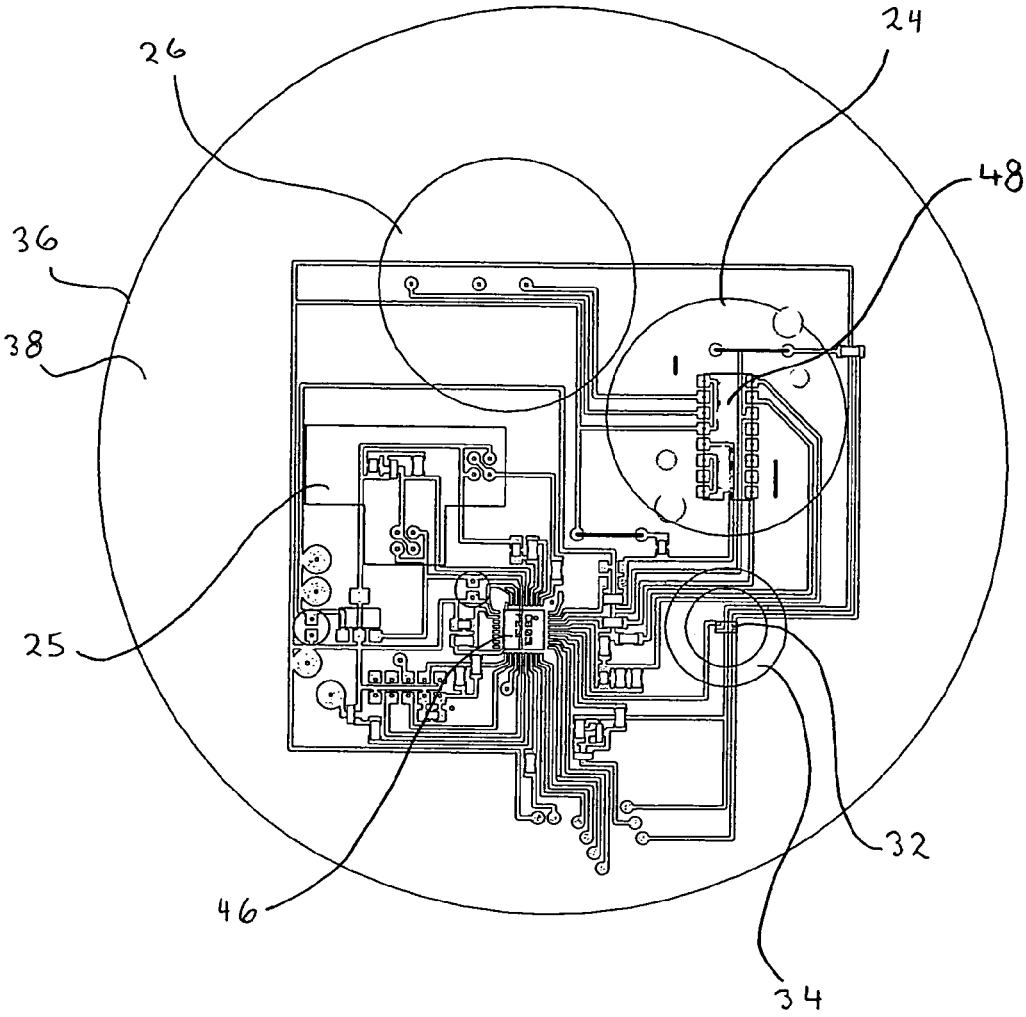
FIG. 6 is a bottom view of the circuit board without a battery installed.

Looking at FIG. 6, a view of the bottom face of the circuit board 38, the general arrangement of the components can be seen. Smoke detector ionization chamber 24 is mounted above smoke detector integrated circuit microchip 48 and adjacent piezoelectric horn 26, and angle alarm optical sensor 32 which is centered above hemispherical cup 34. Microprocessor chip 46 is located approximately centrally on the circuit board 36 and adjacent smoke detector photo sensor 25.

Figure 7:
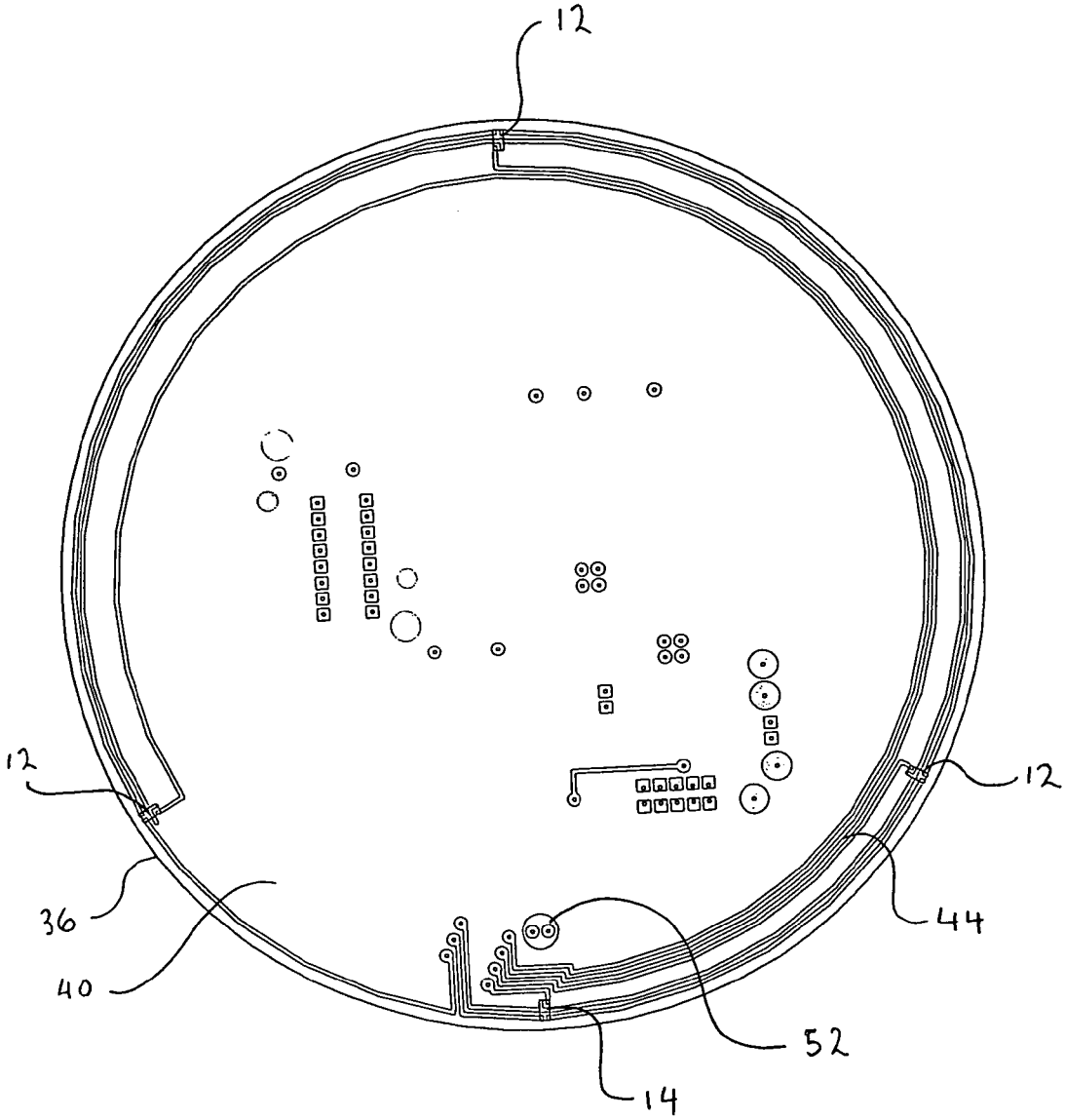
FIG. 7 is a top view of the circuit board.

Looking at FIG. 7, a view of the top face of the circuit board 40 the general arrangement of the remaining components can be seen. Three cigarette optical sensors 12 can be seen spaced at an equal distance in from the outer periphery of the circuit board 36 at approximate 120 degree spacings. Alarm override optical sensor 14 is located approximately equidistant from two of the cigarette optical sensors 12 and adjacent to LED 52. Conductive circuit pathways 44 can be seen traced about the circuit board 36 connecting the various electrical components.

Figure 8:
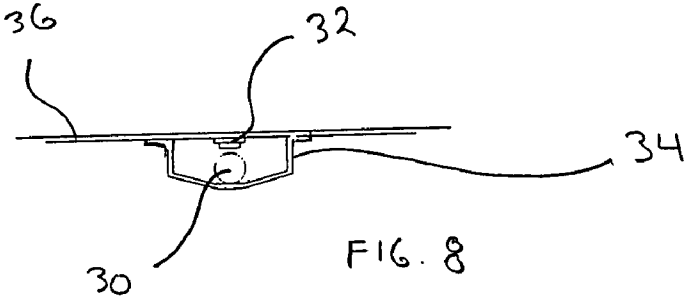
FIG. 8 is a cross sectional view of the angle alarm device.

FIG. 8 shows the ball 30, hemispherical body 34, and angle alarm optical sensor 32 of the angle alarm device, as mounted onto circuit board 36.

To increase the margin of protection afforded to the components and circuit board 36, the main body 2 is constructed from a heat resistant polycarbonate. As additional protection, there is an air filled void 50 between the ashpan 10 and the circuit board 36 and all the components except for the LED light 52, the cigarette optical sensor 12 and the override optical sensor 14 reside on the bottom face 38 of the circuit board 36. A thin heat dissipating circular metal foil disk may be optionally placed in the void 50 between the circuit board 36 and the ashpan 10, although it is not utilized in the preferred embodiment. Testing has not shown the need for an insulator when the ashtray 1 is used with cigarettes but consistent use with cigars in a commercial environment may require installation of such a thermal insulating device.

There are three cigarette optical sensors 12 which are infra red transmitter receivers that work on a reflective sensing capability. They have an infra red light emitting diode (LED) and a matched photo receiver, although it is know that other types of optical sensors can be utilized, these are economical, readily available and reliable. The cigarette optical sensor 12 emits an infra red light and senses any back reflection of the same light which would be encountered if an object was in close proximity to the LED source. Since the ashtray body 2 is translucent to light in the infra red spectrum, the cigarette optical sensor 12, when positioned below and in close proximity to the cigarette groove 8, detects the presence of a cigarette on the groove 8. Once the cigarette optical sensor 12 has detected the presence of a cigarette it sends a signal to the microprocessor 46 which initiates an internally programed algorithmic countdown timer. When this timer completes a first interval of time, the microprocessor 46 activates the LED alarm light 52 and sends a first level arm signal to a driver circuit on the smoke detector microchip 48 that sounds the piezoelectric horn 26. When the cigarette is removed the cigarette optical sensor 12 no longer detects the cigarette, and it both stops it's signal to the microprocessor 26 which in turn stops generation of the first level alarm signal, resets the internally programed algorithmic countdown timer, and switches off the LED alarm light 52. If the cigarette is not attended to by the end of a second consecutive timed interval, the microprocessor 46 sends a second level arm signal to the driver circuit of the smoke detector microchip 48 to sound the alarm horn 26.

While the preferred embodiment ashtray has three cigarette optical sensors 12 positioned about the three cigarette grooves 8, the number of these can vary depending upon the size of the ashtray 1.

Note, that the cigarette optical sensor 12, the override optical sensor 14 and the angle alarm optical sensor 32 are all identical optical sensors. (These are also commonly referred to as photo sensors.) The ashtray's responses to single or multiple sensor signals are defined by the logic programed into the microprocessor 26. In testing, the timing intervals have seen adjusted to be within the range of time for the normal attendance to lit cigarette or cigar. These range from one to three minutes each.

Referring to FIG. 4 again, it can be seen that the angle alarm device is made of a angle alarm optical sensor 32, and a hollow hemispherical body 34 with a ball 30 that is free to move within the body 34. This sensor is also a standard discrete infra red matched LED and infra red receiver unit.

The angle alarm optical sensor 32 is mounted directly above the hemispherical body 34 and at the proximate centerline of the body 34 and ball 30 when the ashtray 1 and angle alarm device is horizontally orientated position. In this manner the ball 30 reflects emitted light back to the angle alarm optical sensor 32 when the ashtray 1 remains within a specific range of angles. Outside of this range of angles it has been experimentally determined that cigarettes will fall from the cigarette grooves 8. Thereafter, the ball 30 will not be in the path of the emitted infra red light and there will be no back reflection to the sensor 32. Following this logic, severe bumping or rapid movement of the astray 1 will also cause the ball 30 to move away from the path of the emitted infra red light, momentarily eliminating any back reflection to the sensor 32.

The override optical sensor 14 is located below an area on the ashpan's flange 4 that is marked to indicate that the user should grip the ashtray 1 with their thumb over the override optical sensor 14 when emptying the astray 1. When this override optical sensor 14 is covered, similar to the cigarette optical sensor's operation, it senses any back reflection of infra red light and sends a signal to the microprocessor 46 which stops generating all audible and visual alarm signals, (including all alarms soon to be initiated by the angle alarm optical sensor 32 if the ashtray is being tipped), and resets the alarm timers. The override optical sensor 14 thus overrides all audible and visual alarm signals sent by the microprocessor 46.

Note, that the angle alarm optical sensor 32 and the cigarette optical sensors 12 elicit responses upon an absence of reflected light within the sensor, while the override optical sensor 14 and the smoke detector photosensor 25 elicit responses based on the detection of infra red light within the sensor. All of these optical/photo sensors are standard discrete infra red matched LED and infra red receiver combination units as is well known in the industry.

A visual alarm light 52 is located adjacent the override optical sensor 14. It is a colored light emitting diode (LED) that is clearly visible through the upper ashtray housing 16. It is activated simultaneously by the microprocessor 46 with either the first or second level audible alarm signal.

There are two types of smoke detecting means utilized in the ashtray 1, a photo sensor smoke detector 25 and an ionization chamber smoke detector 24. Both means sense smoke particles that pass into the vented lower component housing 18 through the vents 20. Since the lowest level the cigarettes are generally located at is the ashpan 10, and since hot smoke rises, the only smoke to enter the lower component housing 18 would be from a cigarette that fell from the ashtray 1 or combusting materials in the vicinity of the ashtray 1, presumably ignited from cigarette residue.

The ionization chamber smoke detector 24 generates a signal which it sends to the smoke detector microchip 48. (The industry standard is used in the preferred embodiment which is a low voltage CMOS integrated circuit Motorola model MC 14467 microchip, although there are other microchips which perform adequately.) This signal increases with the increasing level of smoke detected by the ionization chamber. Once the signal strength increases beyond a certain threshold level as set in the microchip 48, the microchip 48 sends a signal to the microprocessor 46. The microprocessor 46 will then send an alarm signal back to the driver circuit of the microchip 48 to sound the second level (loudest sounding) alarm via the horn 26 and activate the LED 52. (Provided that the override optical sensor 14 is not activated.) The driver circuit of the microchip 48 is used to drive the horn 26 since the microchip 48 has a higher voltage capability than does the microprocessor 46. Thus, the driver circuit on the smoke detector microchip 48 powers the horn 26 but based on a signal input from the microprocessor 46. The microprocessor 46 can send two different signals to be generated by the microchip 48 depending on the desired horn frequency which then determines the corresponding horn sound and volume.

The smoke detector photo sensor 25 is a standard discrete infra red matched LED and infra red receiver positioned in a spaced configuration (approximately ⅜" apart) at right angles to each other on the bottom side of the circuit board 36. Smoke particles moving in the beam path of emitted infra red light from the LED, reflect infra red light onto the receiver. A signal is generated by and sent from the photo sensor 25 directly to the microprocessor 46 (bypassing the smoke detector microchip 48). The signal strength increases with an increasing amount of smoke particles as seen and detected by the phot sensor 25. The microprocessor 46 compares the magnitude of the signal strength through an algorithm to a preset preprogrammed threshold value (that corresponds to a predetermined positive indication of smoke detection). Once this threshold value is exceeded, the microprocessor 46 sends a second level alarm signal to the smoke detector microchip's driver circuit to drive the horn 26 as discussed above, and activates the LED 52. (Provided that the override optical sensor 14 is not activated.) On the detection of smoke from either of the smoke detecting means, the loudest audible alarm or second level alarm, is sounded.

Referring now to the operation of the ashtray 1, the microprocessor 46 receives information from the following four sources: the battery 42, the cigarette optical sensor 12; the override optical sensor 14, the angle alarm optical sensor 32, the smoke detector photo sensor 25, and the smoke detector integrated circuit microchip 48. Based on algorithms programed onto the microprocessor 46, in response to signals from the abovementioned sources, the microprocessor 46 sends one of two different frequency signals to the piezoelectric horn 26 via the smoke detector microchip's driver circuit, resets the internally programed algorithmic countdown timer on the microprocessor, activates a LED light 52, or initiates a rhythmic "chipping" alarm from the horn 26.

The microprocessor 46 used in the preferred embodiment is a Silicon Labs Model 8051 microprocessor, flash programable device, although a plethora of others could be substituted. It has been programed to initiate a first level, second level or battery low alarm signal; to control the tone of the horn 26; to filter and analyze the various sensor inputs; to run the countdown timer; to activate a LED alarm light 52 and it can also vary the threshold smoke detection limit from the smoke detector photo sensor 25 or the threshold smoke detection limit of the smoke detector microchip 48. A power converter is utilized to switch the 9 volt dc power down to approximately 3.3 volts and 25μ amperes to operate the microprocessor 46.

The smoke detector integrated circuit microchip 48 is a low voltage, CMOS, integrated circuit, analogue microchip. The preferred embodiment uses the industry standard Motorola MC 14467 microchip, although substitution of other microchips would render the equivalent performance. The microchip 48 receives a variable signal from the smoke detector ionizing chamber 24 that increases with increasing smoke particle density within the chamber 24. The microchip 48 has a driver circuit on it that powers and sounds the horn 26 in response to the first level alarm signal, the second level alarm signal or the low battery "chirping" signal sent by the microprocessor 46.

The microprocessor 46 generates different audible alarm signals depending upon the algorithmic determination of which level of alarm is to be sounded. There is only one audible alarming device 26 but three distinct audible alarms are emitted. The first level alarm is initiated in response to a cigarette residing in the ashpan 10 beyond a first preprogramed timed interval. The second level alarm is initiated in response to a cigarette residing in the ashpan 10 beyond a second preprogramed timed interval, a tipped ashtray 1, or a positive indication of smoke from either of the smoke detector means. Third, a low voltage level battery 42 will initiate an intermittent "chipping" alarm until such time as the battery 42 dies or is replaced.

The horn 26 is modulated to control the volume level and the tone. This will affect the resonance of the horn. For the first level alarm a quiet, low frequency signal (one that is not a harmonic of the resonant frequency) is generated. For the second level alarm a high decibel, high frequency signal is emitted. The second level alarm is designed to attract more attention than the first level.

All alarms can be over ridden by the alarm override sensor 14, logically since it indicates the presence of an awake person. (Note, that the location of the alarm override sensor is not such that a cigarette fallen from a groove 8 could come to rest above the override sensor, thereby inhibiting the alarm function.)

The actions of the user and/or ashtray and the responses triggered by the microprocessor are best illustrated by the following chart:

| Action | Microprocessor Activated Response |
|---|---|
| put cig in rest | start timer circuit |
| leave cig in rest for longer than 1st preset time (90 sec) | sound 1st level alarm activate light |
| leave cig in rest for longer than 2nd preset time (180 sec) | sound 2nd level alarm activate light |
| remove cig from rest | reset cig timers<br>mute alarm<br>turn off light |
| cover emptying grip (system alarm override) | reset cig timers<br>mute alarm<br>turn off light |
| tip ashtray | sound 2nd level alarm activate light |
| bump ashtray | sound 2nd level alarm activate light |
| stabilize or put ashtray horizontal | mute alarm<br>turn off light |
| smoke enters through vents & triggers ionization chamber | sound 2nd level alarm activate light |
| smoke clears in ionization chamber | mute alarm<br>turn off light |
| smoke enters through vents & triggers photo cell | sound 2nd level alarm activate light |
| smoke clears in photo cell | mute alarm<br>turn off light |
| smoke enters through vents & triggers ionization chamber and photo cell | sound 2nd level alarm activate light |
| smoke clears in ionization chamber or photo cell while other smoke detector still activated | 1st level alarm remains on<br>light remains on |
| smoke clears in ionization chamber and photo cell | mute alarm<br>turn off light |
| battery voltage level drops below preset level | intermittent "chipping" alarm sounds<br>and light is activated |
| battery replaced with new one | mute alarm<br>turn off light |
| battery voltage drops below level to operate unit | alarm cannot sound<br>light cannot come on<br>microprocessors cannot function |

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

Having thus described the invention, what is claimed as new and desired to be secured by Letters Patent is as follows:

1. A microprocessor controlled alarming ashtray designed to provide an early warning of a potential fire situation comprising:

a two piece main body defining an enclosed cavity, formed from the mating engagement between an upper ashpan and a vented lower component housing wherein said body is fabricated from a heat resistant polymer translucent to the infra red spectrum of light;

an audible alarming device;

a smoke detector ionizing chamber;

a smoke detector photo sensor;

a smoke detector integrated circuit microchip, adapted to send a signal to a microprocessor and to drive said audible alarming device in response to an output alarm signal from said microprocessor;

an angle alarm optical sensor;

at least one infra red cigarette optical sensor;

an infra red alarm override optical sensor;

a microprocessor, adapted to analyze input signals from said smoke detector microchip, said angle alarm optical sensor, said infra red cigarette optical sensor and said infra red override optical sensor, and generate output alarm signals, and reset internal timing circuits, as determined by algorithmic functions programmed into said early warning microprocessor; and a power source;

a circuit board held in spaced configuration within said cavity and is adapted to electronically connect and house all components.

2. The microprocessor controlled alarming ashtray of claim 1 wherein there number of said infra red cigarette optical sensors is three.

3. The microprocessor controlled alarming ashtray of claim 2 wherein said audible alarming device is a piezo-electric horn.

4. The microprocessor controlled alarming ashtray of claim 3 wherein said power source is a DC battery.

5. The microprocessor controlled alarming ashtray of claim 3 wherein said power source is a 120 volt AC source transformed to DC power.

6. The microprocessor controlled alarming ashtray of claim 3 wherein said ashpan has a central circular depression for receiving ashes with a raised peripheral ring thereabout having at least one approximately hemispherical cigarette groove normal and therethrough said ring.

7. The microprocessor controlled alarming ashtray of claim 6 wherein the number of cigarette grooves is three.

8. The microprocessor controlled alarming ashtray of claim 7 wherein one of said infra red cigarette optical sensors is located on said circuit board below and adjacent each said cigarette groove.

9. The microprocessor controlled alarming ashtray of claim 8 wherein said raised peripheral ring of said ashpan has an adjacent generally planar outer ring.

10. The microprocessor controlled alarming ashtray of claim 9 wherein said infra red override optical sensor is located on said circuit board below and adjacent said planar outer ring.

11. The microprocessor controlled alarming ashtray of claim 10 wherein said angle alarm optical sensor is comprised of an infra red matched led and infra red receiver affixed to said circuit board and positioned directly above a reflective sphere contained between said circuit board and a hemispherical chamber such that said angle sensitive photo sensor switch detects when said sphere resides in an approximate center of said chamber.

12. The microprocessor controlled alarming ashtray of claim 11 wherein said smoke detector integrated circuit microchip contains a driver circuit that sends a signal to sound said horn in response to said microprocessor output alarm signal.

13. The microprocessor controlled alarming ashtray of claim 1 further comprising a visual alarm warning light emitting diode and wherein said microprocessor is further adapted to analyze input signals from said smoke detector microchip, said angle alarm optical sensor, said infra red cigarette optical sensor and said second infra red override optical sensor and generate output alarm signals to activate said light emitting diode as determined by algorithmic functions programmed into said microprocessor.

14. A battery powered microprocessor controlled audibly alarming ashtray having an infra red translucent main body defining an enclosed cavity formed from the mating engagement between an upper ashpan and a vented lower component housing, wherein said microprocessor controlled audibly alarming ashtray comprises the following components:

at least one smoke sensing device;

a tipped ashtray sensing device;

at least one cigarette sensing device;

a tipped ashtray sensing override device;

an audible alarming device; and a microprocessing means adapted to initiate said audible alarming device according to a programed algorithmic logic in response to signals generated from said smoke sensing device, said tipped ashtray sensing device said cigarette sensing device and said tipped ashtray sensing override device.

15. The microprocessor controlled alarming ashtray of claim 14 further comprising a circuit board adapted to hold all components in a spaced configuration within said enclosed cavity.

16. The microprocessor controlled alarming ashtray of claim 15 wherein said smoke sensing device is comprised of a smoke detector integrated circuit microchip adapted to receive signals from at least one said smoke detector means and generate signals to said microprocessor in response to the detection of smoke from said smoke detector means.

17. The microprocessor controlled alarming ashtray of claim 16 wherein said ashpan has at least one cigarette rest formed thereon and said sensing timer device is an infra red matched light emitting diode and infra red receiver positioned on said circuit board below, adjacent and in close proximity to said cigarette rest such that detection of a cigarette on said rest is facilitated by infra red light reflectance.

18. The microprocessor controlled alarming ashtray of claim 17 wherein said tipped ashtray sensing device is an infra red matched light emitting diode and infra red receiver positioned on said circuit board adjacent and above an unconstrained sphere in a hemispherical race such that tipping of said ashtray causes said sphere to move such that there is no infra red light reflectance from said sphere onto said receiver.

19. The microprocessor controlled alarming ashtray of claim 18 wherein said a tipped ashtray sensing override device is an infra red matched light emitting diode and infra red receiver positioned on said circuit board below, adjacent and in close proximity to said upper ashpan such that detection of a users digit on said ashpan is facilitated by infra red light reflectance.

20. The microprocessor controlled alarming ashtray of claim 19 further comprising a light emitting diode adapted to activate upon the generation of an alarm signal from said microprocessor.

* * * * *